US006257685B1

(12) United States Patent
Ishikawa

(10) Patent No.: US 6,257,685 B1
(45) Date of Patent: Jul. 10, 2001

(54) INK DROPLET EJECTING METHOD AND APPARATUS

(75) Inventor: Hiroyuki Ishikawa, Nisshin (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 0 days.

(21) Appl. No.: 09/200,950

(22) Filed: Nov. 30, 1998

(30) Foreign Application Priority Data

Dec. 16, 1997 (JP) ..... 9-346723

(51) Int. Cl.[7] ..... B41J 29/38; B41J 2/205

(52) U.S. Cl. ..... 347/10; 347/10; 347/11; 347/15

(58) Field of Search ..... 347/10, 11, 15; 358/298

(56) References Cited

U.S. PATENT DOCUMENTS

| | | | | |
|---|---|---|---|---|
| 5,028,936 | | 7/1991 | Bartky et al. . | |
| 5,521,619 | * | 5/1996 | Suzuki et al. | 347/10 |
| 5,805,177 | * | 9/1998 | Takahashi | 347/11 |
| 6,079,806 | * | 6/2000 | Wen et al. | 347/10 |
| 6,092,886 | * | 7/2000 | Hosono | 347/10 |
| 6,095,630 | * | 8/2000 | Horii et al. | 347/10 |

FOREIGN PATENT DOCUMENTS

| | | | | |
|---|---|---|---|---|
| 63-247051 | | 10/1988 | (JP) | B41J/3/04 |
| 2-2008 | | 1/1990 | (JP) | B41J/2/05 |
| 05016427 | * | 1/1993 | (JP) | B41J/2/445 |

* cited by examiner

*Primary Examiner*—John Barlow
*Assistant Examiner*—Alfred Dudding
(74) *Attorney, Agent, or Firm*—Oliff & Berridge, PLC

(57) ABSTRACT

An ink droplet ejecting method and apparatus are provided that are capable of effecting printing at a high resolution and a high quality, and at the same time capable of preventing a drop-out in white and a decrease of print density from occurring, for example, in printing a solid pattern. As a jet pulse signal, a pulse signal is used which, when ejection of ink is performed in a continuous manner, provides a small ink droplet for only a first dot, and large ink droplets for second and subsequent dots and which, when ejection of ink is performed intermittently at intervals of only one dot, provides small ink droplets for all of the ink droplets formed. As a result, a small print portion becomes attractive, and the resolution can be enhanced. Further, in the case of continuous dots, no gap is formed between adjacent dots.

22 Claims, 11 Drawing Sheets

INK DROPLET EJECTING METHOD AND APPARATUS

BACKGROUND OF THE INVENTION

1. Field of the Invention

The invention relates to an ink droplet ejecting method and apparatus of an ink jet type.

2. Description of Related Art

According to a known ink jet printer of an ink jet type, the volume of an ink flow path is changed by deformation of a piezoelectric ceramic material. When the ink flow path volume decreases, the ink present in the ink flow path is ejected as a droplet from a nozzle. However, when the ink flow path volume increases, the ink is introduced into the ink flow path from an ink inlet. In this type of printing head, multiple ink chambers are formed by partition walls of a piezoelectric ceramic material. An ink supply device such as ink cartridges, are connected to one end of each of the multiple ink chambers. The opposite end of each of the ink chambers is provided with an ink ejecting nozzle (hereinafter referred to simply as "nozzles"). The partition walls are deformed in accordance with printing data to make the ink chambers smaller in volume, whereby ink droplets are ejected onto a printing medium from the nozzles to print, for example, a character or a figure.

An example of this type of an ink jet printer is a drop-on-demand type ink jet printer that ejects ink droplets, which is popular because of a high ejection efficiency and a low running cost. An example of a drop-on-demand type ink jet printer is a shear mode type that uses a piezoelectric material, which is disclosed in Japanese Published Unexamined Patent Application No. Sho 63-247051.

As shown in FIGS. 12(*a*) and 12(*b*), this type of ink droplet ejecting apparatus 600 includes a bottom wall 601, a top wall 602 and shear mode actuator walls 603 located therebetween. The actuator walls 603 each include a lower wall 607 bonded to the bottom wall 601 and polarized in the direction of arrow 611, and an upper wall 605 formed of a piezoelectric material, t h e upper wall 605 being bonded to the top wall 602 and polarized in the direction of arrow 609. Adjacent actuator walls 603, as a pair, define an ink chamber 613 therebetween. The actuator walls 603 that are adjacent the ink chamber, in a pair, define a space 615 which is narrower than the ink chamber 613.

A nozzle plate 617 having nozzles 616 is fixed to one end of each of the ink chambers 613, while the opposite end of each of the ink chambers is connected to an ink supply source (not shown). Electrodes 619 and 621 are respectively formed on both side faces of each actuator wall 603, as metallized layers. More specifically, electrode 619 is formed on the actuator wall 603 on the side of the ink chamber 613, while electrode 621 is formed on the actuator wall 603 on the side of the space 615. The surface of electrode 619 is covered with an insulating layer 630 for insulation from ink. Electrode 621, which faces the space 615 is connected to a ground 623, and electrode 619, which is provided in each ink chamber 613, is connected to a controller 625, which provides an actuator drive signal to the electrode.

The controller 625 applies a voltage to the electrode 619 in each ink chamber, whereby the associated actuator walls 603 deform, by virtue of the piezoelectric material, in directions to increase the volume of the ink chamber 613. For example, as shown in FIG. 13, when voltage E(V) is applied to an electrode 619*c* in an ink chamber 613*c*, electric fields are generated in the directions of arrows 631 and 632 respectively in actuator walls 603*e* and 603*f*, so that the actuator walls 603*e* and 603*f* deform in directions to increase the volume of the ink chamber 613*c*. At this time, the internal pressure of the ink chamber 613*c*, including a nozzle 618*c* and the vicinity thereof, decreases. The applied state of the voltage E(V) is maintained for only a one-way propagation time T of a pressure wave in the ink chamber 613. During this period, ink is supplied from the ink supply source.

Similarly, where voltage is applied to electrodes 619*a*, 619*b* and 619*d* in respective ink chambers 613*a*, 613*b* and 613*d*, electric fields are generated in respective actuator walls 603*a*, 603*b*, 603*c*, 603*d* and 603*g*. Each of the ink chambers 613*a*, 613*b* and 613*d* include corresponding nozzles 618*a*, 618*b* and 618*d*.

The one-way propagation time T is a time required for the pressure wave in the ink chamber 613 to propagate longitudinally through the same chamber. Given that the length of the ink chamber 613 is L and the velocity of sound in the ink present in the ink chamber 613 is a, the time T is determined to be T=L/a.

According to the theory of pressure wave propagation, upon lapse of time T, or an odd-multiple time thereof, after the above application of voltage, the internal pressure of the ink chamber 613 reverses into a positive pressure. In conformity with this timing, the voltage being applied to the electrode in the ink chamber 613*c* is returned to 0(V). As a result, the actuator walls 603*e* and 603*f* revert to their original state (FIGS. 12(*a*) and 12(*b*)) before the deformation, whereby a pressure is applied to the ink. At this time, the above positive pressure, and the pressure developed by the reverting of the actuator walls 603*e* and 603*f* to their original state before the deformation, are added together to provide a relatively high pressure in the vicinity of the nozzle 618*c* in the ink chamber 613*c*, whereby an ink droplet is ejected from the nozzle 618*c*. An ink supply passage 626, shown in FIG. 12(*b*), that communicates with each of the ink chambers 613, is formed by members 627 and 628.

In this type of ink droplet ejecting apparatus 600, it is necessary to eject a small ink droplet in order to attain high print resolution. However, in printing a solid pattern by continuous dot ejection, a drop-out in white may occur, or the print density may become low, because the ink droplet is small. In the case where all of the dots formed during printing are large, the initial writing portion of a figure and fine patterns, are not attractive, or fine lines may become thick to a greater extent than necessary, thus giving rise to the problem that the print quality is deteriorated.

Japanese Published Unexamined Patent Application No. Hei 2-2008 discloses an ink droplet ejecting apparatus wherein, when a printing-free period has been detected, the electric power of a jet pulse for subsequent printing is controlled, to solve the problem of the printed image density being lowered at the initial stage of printing. However, even if such a control is made, the occurrence of a drop-out in white as noted above still remains unsolved when a solid pattern is printed using small ink droplets for effecting high resolution printing.

SUMMARY OF THE INVENTION

The invention solves the above-mentioned problems, and it is an object of the invention to provide an ink droplet ejecting method and apparatus, wherein, when printing is to be performed continuously, the volume of each ink droplet is made small at only the first dot, and is made large at the second and subsequent dots. However, when printing is to be conducted at certain intervals, the volume of each ink droplet is made small, thereby making it possible to effect printing at a high resolution. Further, in printing a solid pattern, for example, a drop-out in white, or the decrease of the print density, no longer occur, and high quality printing can be performed.

In order to achieve the above-mentioned object, an ink droplet ejecting method is provided, wherein a jet pulse signal is applied to an actuator, which is for changing the volume of an ink chamber filled with ink, to generate a pressure wave within the ink chamber, thereby applying pressure to the ink and allowing a droplet of the ink to be ejected from a nozzle. In accordance with a single dot or multiple continuous dots printing instruction, one or multiple jet pulse signals are applied to the actuator at a predetermined cyclic timing to eject an ink droplet. As the jet pulse signal(s), a pulse signal is used which, in a continuous ejection of ink, provides a small ink droplet at only the first ink ejection, and provides larger ink droplets at the second and subsequent ink ejections. According to this method, since the first ink droplet is small in a continuous ink ejection, a fine print portion becomes attractive and the resolution can be enhanced, while at the second and subsequent ink ejections larger ink droplets are used, so that no gap is formed between adjacent dots of continuous dots.

In accordance with another aspect of the ink droplet ejecting method, as the jet pulse signal(s), a jet pulse signal is used which, when ejection of ink is performed at intervals of only one dot, provides small ink droplets as all of the ink droplets formed. According to this method, when ejection of ink is performed at certain intervals, fine portions such as characters and patterns can be printed attractively without being collapsed, and it is possible to enhance the resolution.

In accordance with another aspect of the ink droplet ejecting method, as a jet pulse signal(s) for reducing the size of an ink droplet, one or multiple pulse signals are used which are selected from the group consisting of a pulse signal whose peak value has been made small, a pulse signal whose pulse width has been made small, a pulse signal with a control pulse added thereto, a pulse signal whose rise timing or fall timing has been changed, and a pulse signal whose printing frequency has been changed.

An ink droplet ejecting apparatus is also provided that includes an ink chamber filled with ink, an actuator for changing the volume of the ink chamber, a driving power source for applying an electric signal to the actuator, and a controller which provides control so that, in accordance with a one-dot printing instruction, a jet pulse signal is applied to the actuator from the driving power source to eject the ink present in the ink chamber. The controller provides control so that, in accordance with a single dot or multiple continuous dots printing instruction, one or multiple jet pulse signals are applied to the actuator at a predetermined cyclic timing to eject an ink droplet. As the jet pulse signal(s), there is selected a pulse signal which, in a continuous ejection of ink, provides a small ink droplet at only the first ink ejection, and provides larger ink droplets at the second and subsequent ink ejections. This structure provides the same advantages as were attained with the method discussed above.

In accordance with another aspect of the ink droplet ejecting apparatus, the controller provides control so that, as the jet pulse signal(s), a pulse signal is selected which, when ejection of ink is performed at intervals of only one dot, affords small ink droplets as all of the ink droplets formed.

In accordance with another aspect of the ink droplet ejecting apparatus, the controller provides control so that, as a jet pulse signal(s) for reducing the size of an ink droplet, one or multiple pulse signals are used which are selected from the group consisting of a pulse signal whose peak value has been made small, a pulse signal whose pulse width has been made small, a pulse signal with a control pulse auded thereto, a pulse signal whose rise timing or fall timing has been changed, and a pulse signal whose printing frequency has been changed.

According to the ink droplet ejecting method and apparatus of the invention, as set forth above, when ink droplets are ejected continuously, the ink droplet in the first ejection is made small, and the second and subsequent ink droplets are made large. When ink droplets are ejected intermittently at intervals of only one dot, all of the ink droplets formed are made small, so that the resolution is enhanced and minute portions, such as characters and patterns, can be printed attractively. Further, in the case where dots are continuous, or in the case of printing a solid pattern, the occurrence of a drop-out in white, or a decrease of print density, is prevented, permitting high-quality printing.

BRIEF DESCRIPTION OF THE DRAWINGS

A preferred embodiment of the invention will be described in detail with reference to the following figures wherein.

DETAILED DESCRIPTION OF THE PREFERRED EMBODIMENT

Figure 12A:
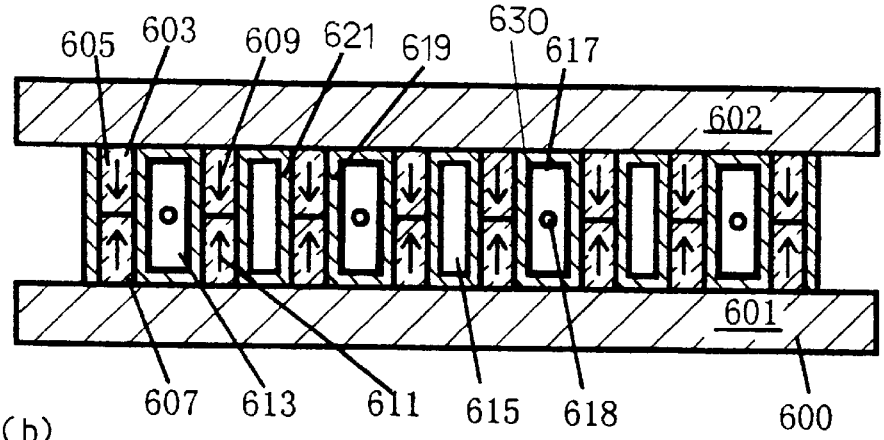
FIG. 12(*a*) is a longitudinal sectional view of the ink droplet ejecting apparatus, and FIG. 12(*b*) is a transverse sectional view thereof.
Figure 12B:
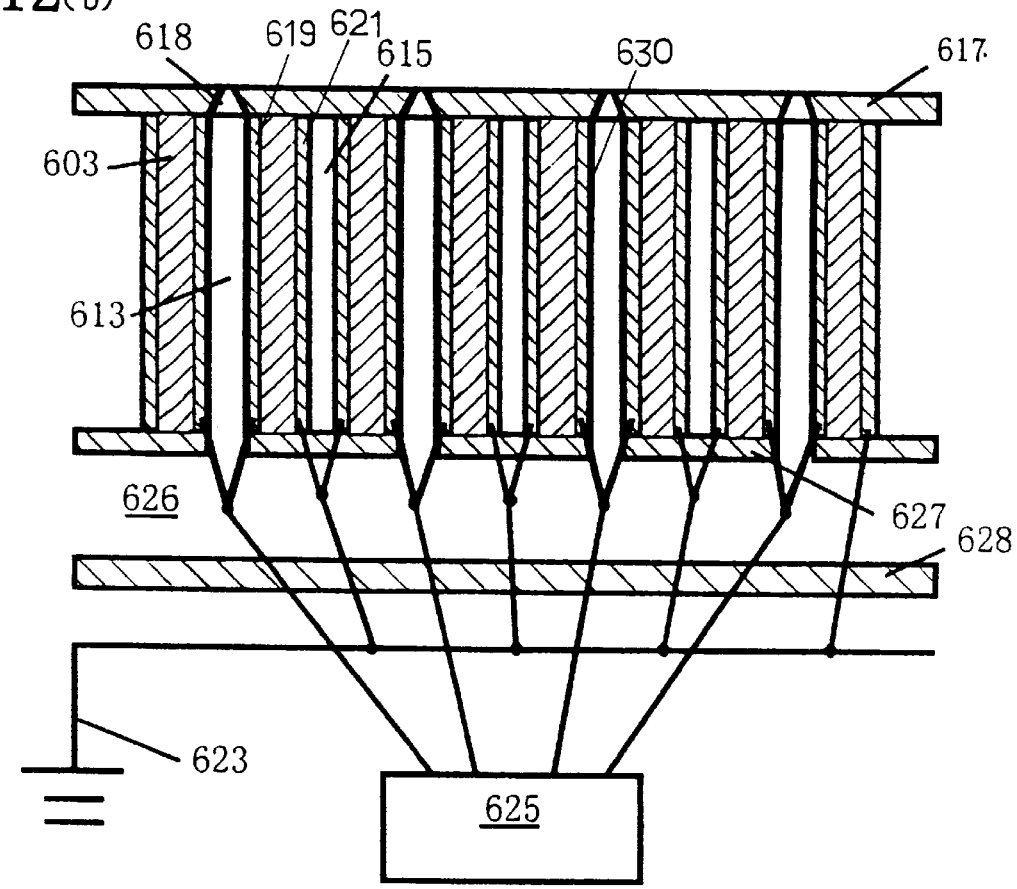
Figure 13:
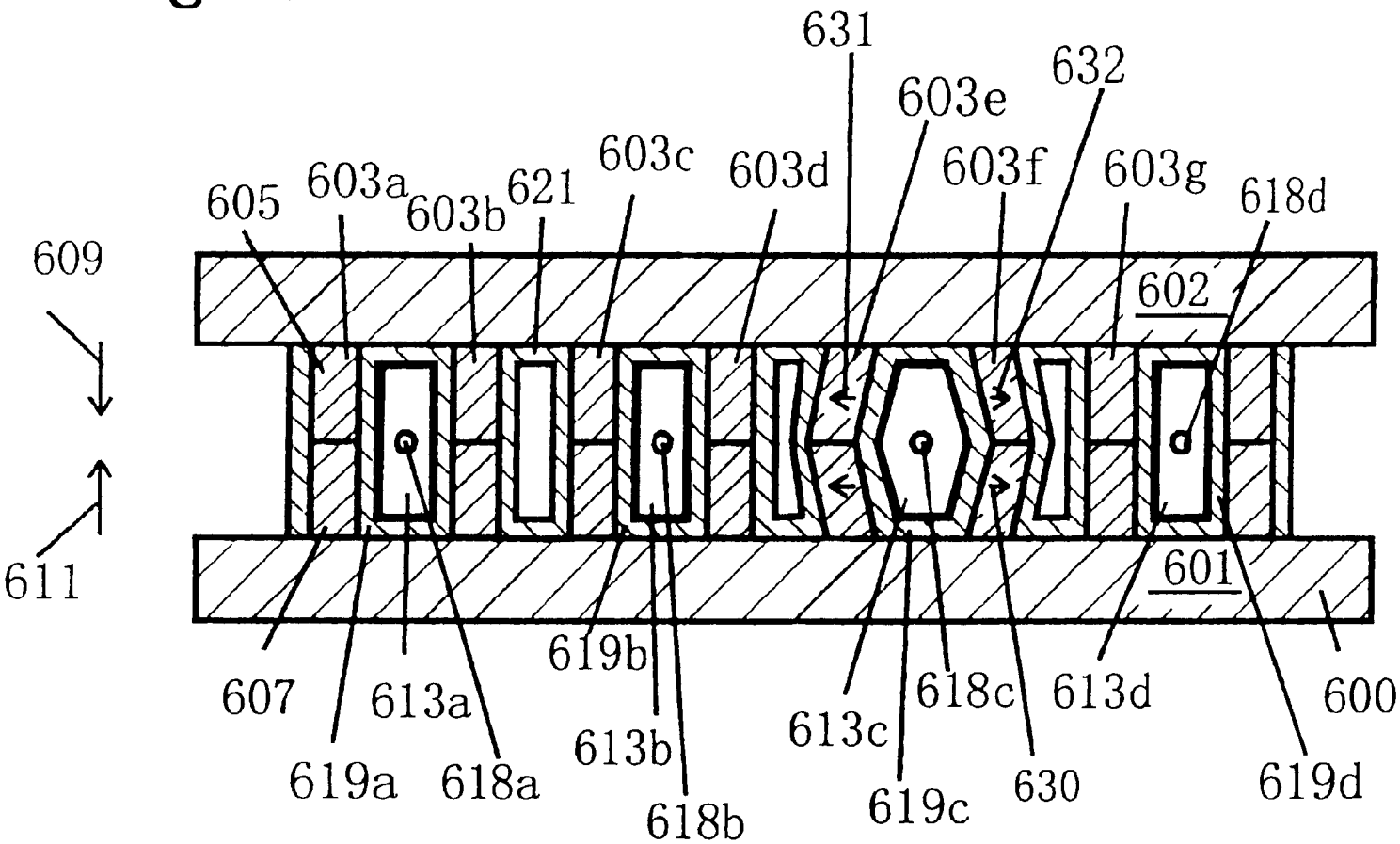
FIG. 13 is a longitudinal sectional view showing an ink ejecting operation of the ink droplet ejecting apparatus.

An embodiment of the invention will be described herein under with reference to the drawings. The structure of a mechanical portion in an ink droplet ejecting apparatus of this embodiment is the same as that shown in FIGS. 12(*a*) and 12(*b*), and therefore an explanation thereof is omitted.

An example of specific dimensions of this ink droplet ejecting apparatus 600 will now be described. The length L of an ink chamber 613 is 9 mm. As to the dimensions of a nozzle 618, its diameter on an ink droplet ejection side is 40 μmm, its diameter on the ink chamber 613 side is 72 μm, and its length is 100 μm. In an experiment, the viscosity at 25° C. of ink used was about 2 mPas, and the surface tension thereof was 30 mN/m. The ratio, L/a (=T), of the above length L to a sonic velocity, a, in the ink present within the ink chamber 613 was 15 μsec.

Now, with reference to FIG. 1, a description will be given of an ink droplet ejected by a driving waveform (a jet pulse signal) which is applied to an electrode 619 disposed-in the ink chamber 613 in this embodiment.

Figure 1A:
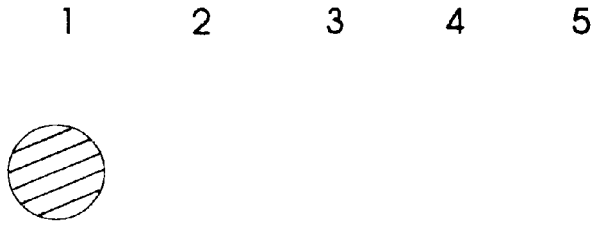
FIGS. 1(*a*)–1(*c*) are diagrams showing ink droplets to be ejected according to an ink droplet ejecting method embodying the invention, in which FIG. 1(*a*) is a diagram showing an ink droplet used in ejecting only one dot, FIG. 1(*b*) is a diagram showing ink droplets to be ejected in a continuous manner, and FIG. 1(*c*) is a diagram showing ink droplets used in an intermittent ejection.
Figure 1B:
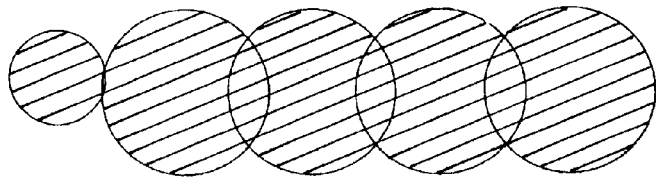
Figure 1C:
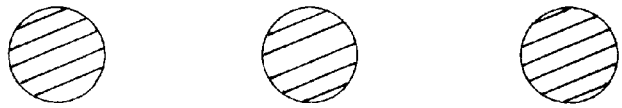

FIGS. 1(*a*) and l(*b*) respectively illustrate an ink droplet which is ejected alone, and ink droplets which are ejected at certain intervals. In both cases, a control is provided to make the ink droplets small in size. FIG. 1(*b*) illustrates ink droplets which are ejected in a continuous manner, and of which only the first droplet is small, and the second and subsequent droplets are large. Numerals 1 to 5 are numbers assigned to continuous dots.

The following description is now provided regarding various methods for obtaining droplet sizes as shown in FIG. 1 by using the jet pulse signal A in accordance with a single dot or multiple continuous dots printing instruction.

Figures 2A, 2B, 2C:
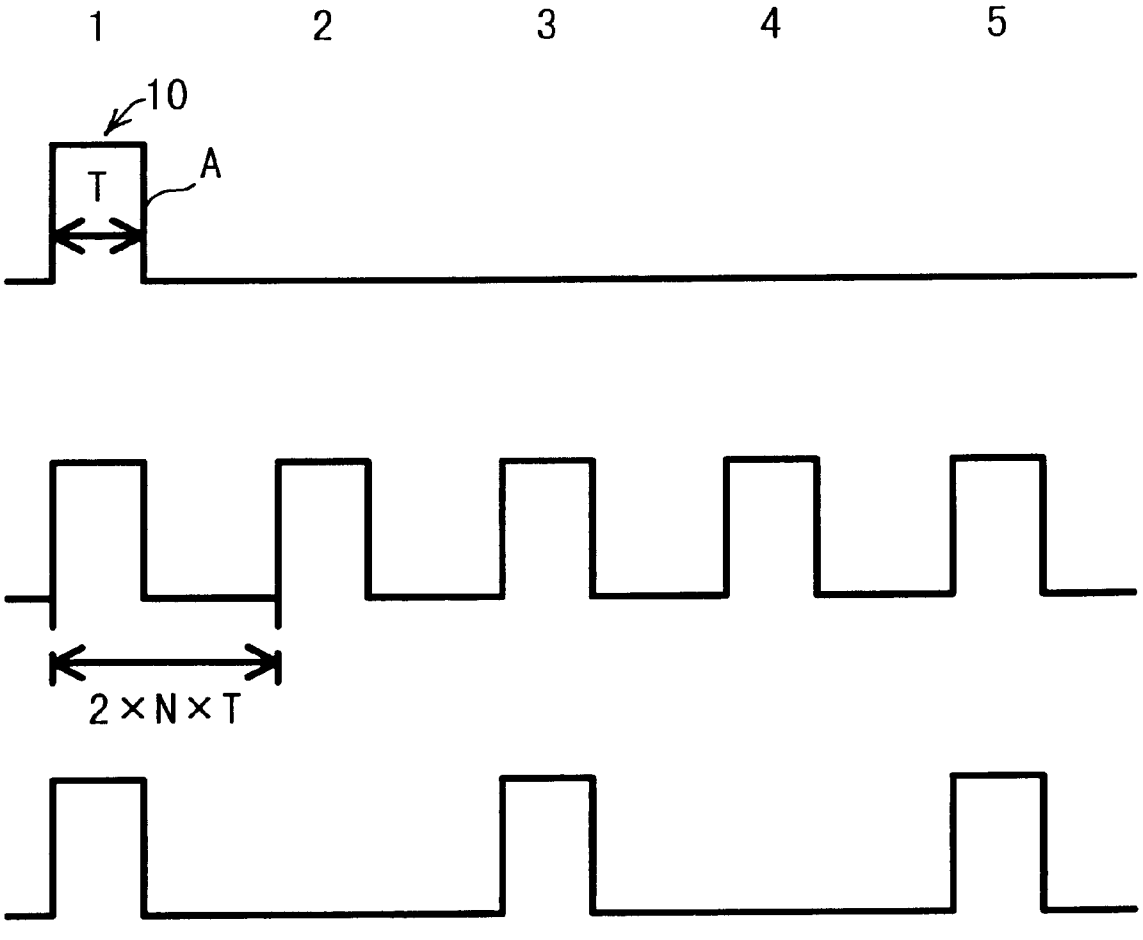
FIGS. 2(*a*)–2(*c*) are diagrams showing a method for reducing the size of the first ink droplet by using a driving waveform.

FIGS. 2(*a*)–2(*c*) are diagrams showing a method for reducing the size of the first ink droplet by using a driving waveform. FIGS. 2(*a*)–2(*c*) each correspond respectively to the (a), (b) and (c) figures of FIGS. 1(*a*)–1(*c*). Thus, FIG. 2(*a*) shows a waveform for ejecting a single droplet. FIG. 2(*b*) shows waveforms for ejecting droplets in a continuous manner. FIG. 2(*c*) shows waveforms for ejecting droplets at certain intervals.

As shown in FIG. 2(*a*), a driving waveform 10 is a jet pulse signal A to eject an ink droplet for printing one dot. Its peak value (voltage value) is, for example, 20(V). The wave width of the jet pulse signal A is set equal to an odd-multiple (a value peculiar to a head) of the ratio, L/a (=T), of the above length L to a sonic velocity, a, in the ink present within the ink chamber 613. For example, T is assumed equal to 15 μsec.

As shown in FIG. 2(*b*), the pulse cycle in the case of printing the next dot in a continuous manner is 100 μsec (about 6.66T at T=15 μsec), assuming that the driving frequency is 10 kHz, (the frequency is a reciprocal of the cycle). In particular, a printing frequency of a predetermined timing period of applying multiple jet pulses to print dots in a continuous manner is set to be a reciprocal of an even-numbered multiple of the time T in which a pressure wave propagates within the ink chamber one-way. The printing frequency of the predetermined timing period can also be set to be a range centered around a reciprocal of an even numbered multiple of the time T in which a pressure wave propagates within the ink chamber one-way when the printing density is increased. The range can be defined as $2N-0.4)\times T$ to $(2N+0.4)\times T$, wherein N is an integer.

The range shown in FIG. 2(*c*) is greater than the range of FIG. 2(*b*), as discussed above, so as to eject droplets at certain intervals.

Figure 3A:
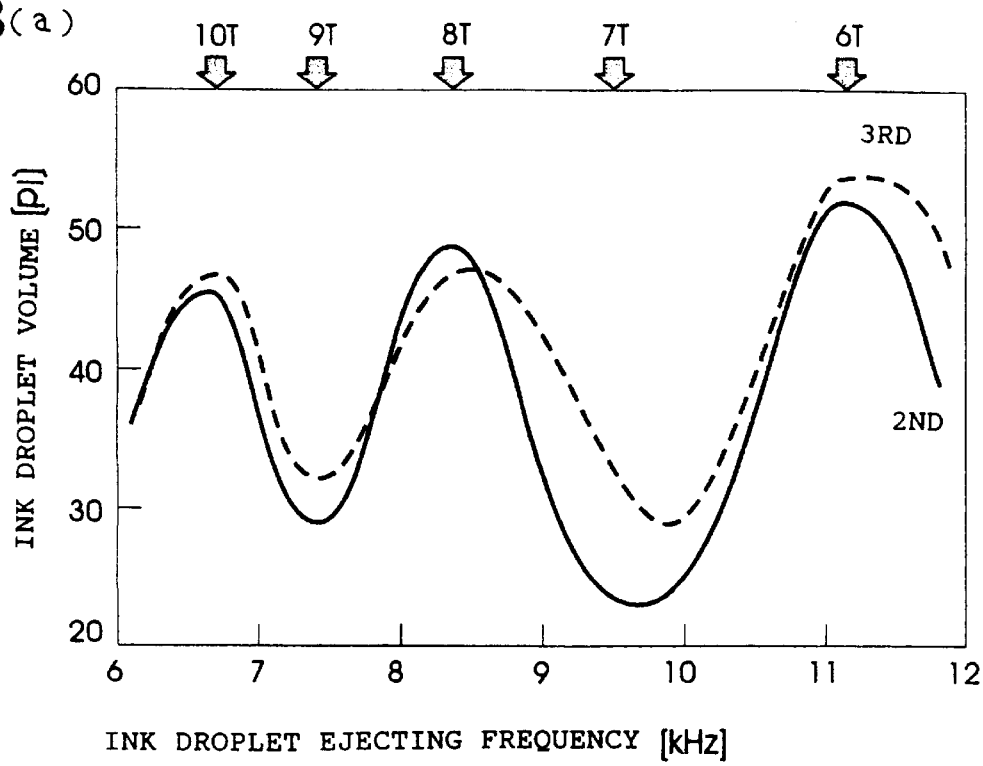
FIG. 3(*a*) is a diagram showing measurement data of the ink droplet volume at different ink droplet ejecting frequencies, and FIG. 3(*b*) is a diagram showing measurement data of the ink droplet volume in the first to the fifth ink droplet ejection performed at different cycles.
Figure 3B:
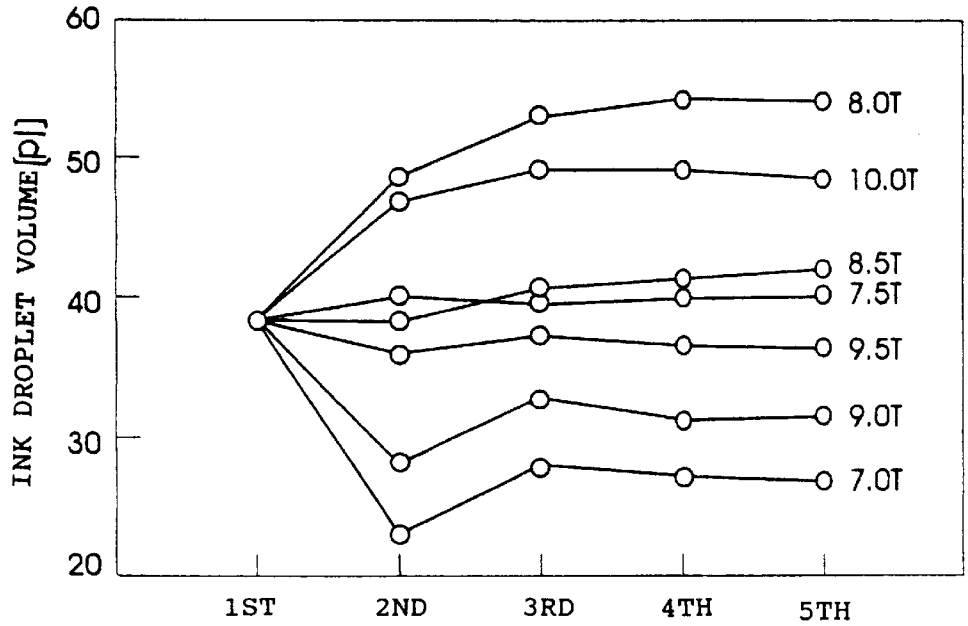

FIG. 3(*a*) shows ink droplet volumes at different ink droplet ejecting frequencies, in which measurement data at various frequencies in the second and third droplet ejections have been plotted as lines. FIG. 3(*b*) shows ink droplet volumes in the first to fifth ejections performed using various cycles (7.0T to 10.0T). The ink droplet volume in the first ejection adopts a value peculiar to the ink droplet ejecting apparatus irrespective of frequency, which is about 40 pl (picoliter) (ink droplet speed is about 7 m/s) in this embodiment.

As shown in FIG. 3(*b*), as to the second and third droplet ejections, the ink droplet volume increases when the cycle is an even-multiple (6T, 8T, 10T) of time T, in comparison with the first droplet ejection. The cycle 8T corresponds to 120 μsec, and the frequency at this time is approximately 8.3 kHz. Such a characteristic permits the second and subsequent dots to be larger in ink droplet volume than the first dot if an appropriate printing frequency is selected.

Figure 4:
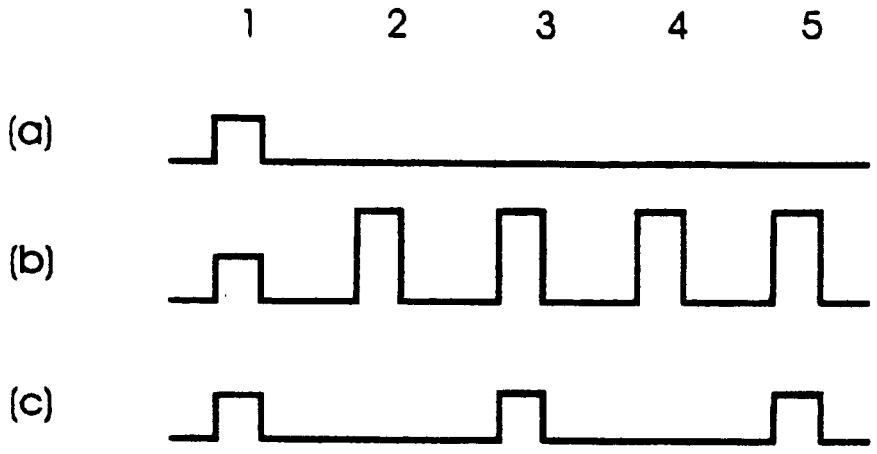
FIGS. 4(*a*)–4(*c*) are diagrams showing a method for reducing the size of the first ink droplet by using a driving waveform.

FIGS. 4(*a*) to 7(*c*) illustrate other methods for reducing the size of the first ink droplet with the driving waveform 10. In each of FIGS. 4(*a*)–7(*c*), the (a), (b) and (c) figures correspond respectively to the (a), (b) and (c) figures of FIGS. 1(*a*)–1(*c*). The method shown in FIGS. 4(*a*)–4(*c*) changes the voltage value (peak value) of the jet pulse signal. In a continuous dot ejection as shown in FIG. 4(*b*), the voltage value is increased in the second and subsequent ejections, thereby making it possible to relatively enlarge the ink droplet volume in the second and subsequent ejections. The increased voltage value can be 22 V. In the case of only one dot ejection as shown in FIG. 4(*a*), and the case where ejection is performed at certain intervals as shown in FIG. 4(*c*), a pulse of a low voltage value equal to that of the first dot in the above continuous dot ejection is generated. The low voltage value can be 18 V.

Figure 5:
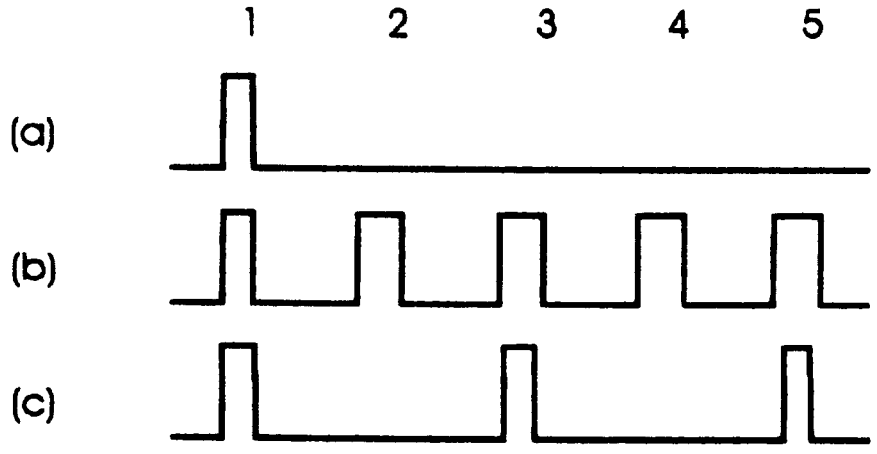
FIGS. 5(*a*)–5(*c*) are diagrams showing a method for reducing the size of the first ink droplet by using a driving waveform.

In FIGS. 5(*a*)–5(*c*), the pulse width is changed. The pulse width of the first dot in the continuous dot ejection as shown in FIG. 5(*b*), and the pulse width in the other cases shown in FIG. 5(*a*) and 5(*c*), are shifted intentionally from an appropriate value (an odd-multiple of T) to reduce the ink droplet volume, so that the same advantages as discussed above are attained. The pulse width of FIGS. 5(*a*) and 5(*c*), as well as the pulse width of the first droplet of FIG. 5(*b*), can be 12 μs. The pulse width of the second and subsequent droplets of FIG. 5(*b*) can be 15 μs.

Figure 6:
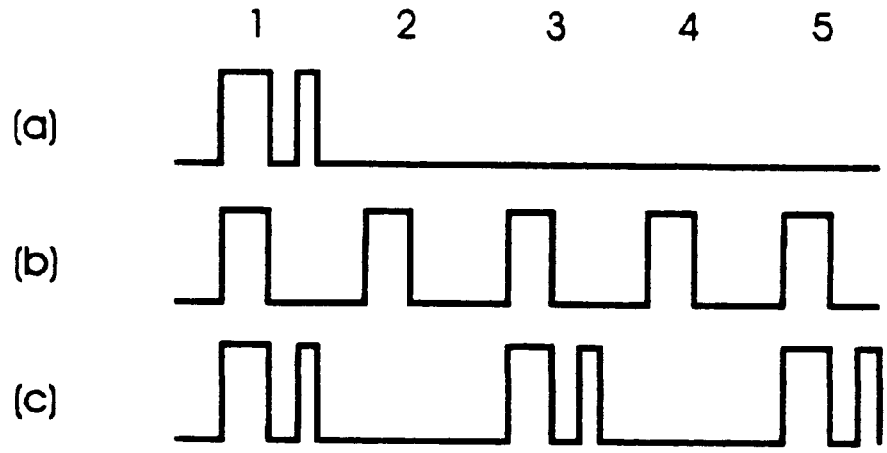
FIGS. 6(*a*)–6(*c*) are diagrams showing a method for reducing the size of the first ink droplet by using a driving waveform.

In FIG. 6(*a*)–6(*c*), a pulse for control is added. More specifically, a non-jet pulse (smaller in pulse width than the jet pulse signal) is added to the jet pulse signal used in the one-dot ejection shown in FIG. 6(*a*), and the spaced ejection shown in FIG. 6(*c*), so that it is possible to reduce the size of an ink droplet being ejected. This non-jet pulse functions to increase the volume of the ink chamber at a timing of pulling back a part of the ink droplet which has rushed out from the nozzle in accordance with the jet pulse signal as a primary pulse signal. In the case of a continuous dot ejection shown in FIG. 6(*b*), as explained above in connection with FIGS. 3(*a*) and 3(*b*), the first dot can be made small in size by setting the printing frequency appropriately. However, the non-jet pulse may also be added to the first pulse as shown in FIGS. 6(*a*) and 6(*c*). If the pulse width of the jet pulse signal is represented as T, then the pulse width of the non-jet pulse signal can be 0.35T.

Figure 7:
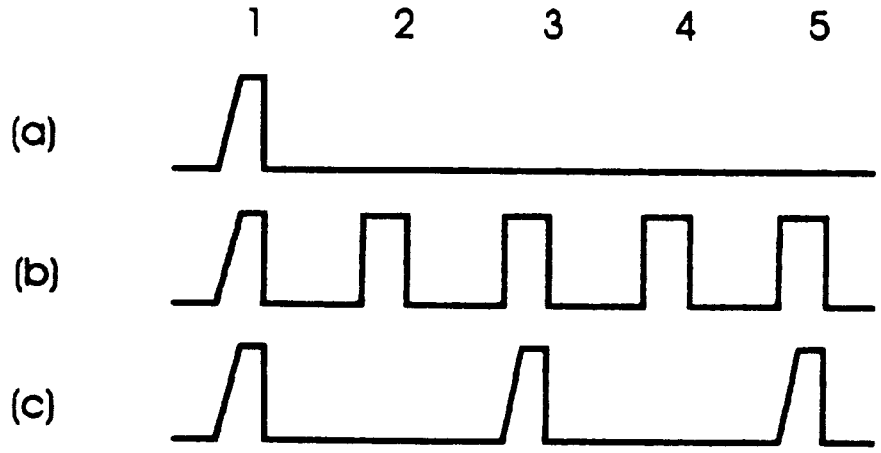
FIGS. 7(*a*)–7(*c*) are diagrams showing a method for reducing the size of the first ink droplet by using a driving waveform.

In FIGS. 7(*a*)–7(*c*), the rise-timing or fall timing of the pulse is changed. In this example, the rise timing of the pulse is made gentle with respect to a dot whose size is to be reduced. If the pulse width of the jet pulse signal is represented as T, then the pulse width of the gentle rise timing of the pulse can be 0.25T.

Not only are each of the foregoing frequency, voltage value, pulse width, additional non-jet pulse, and the rise and fall timings of the pulse, determined independently, but they may also be combined to control the volume of an ink droplet.

Figure 8:
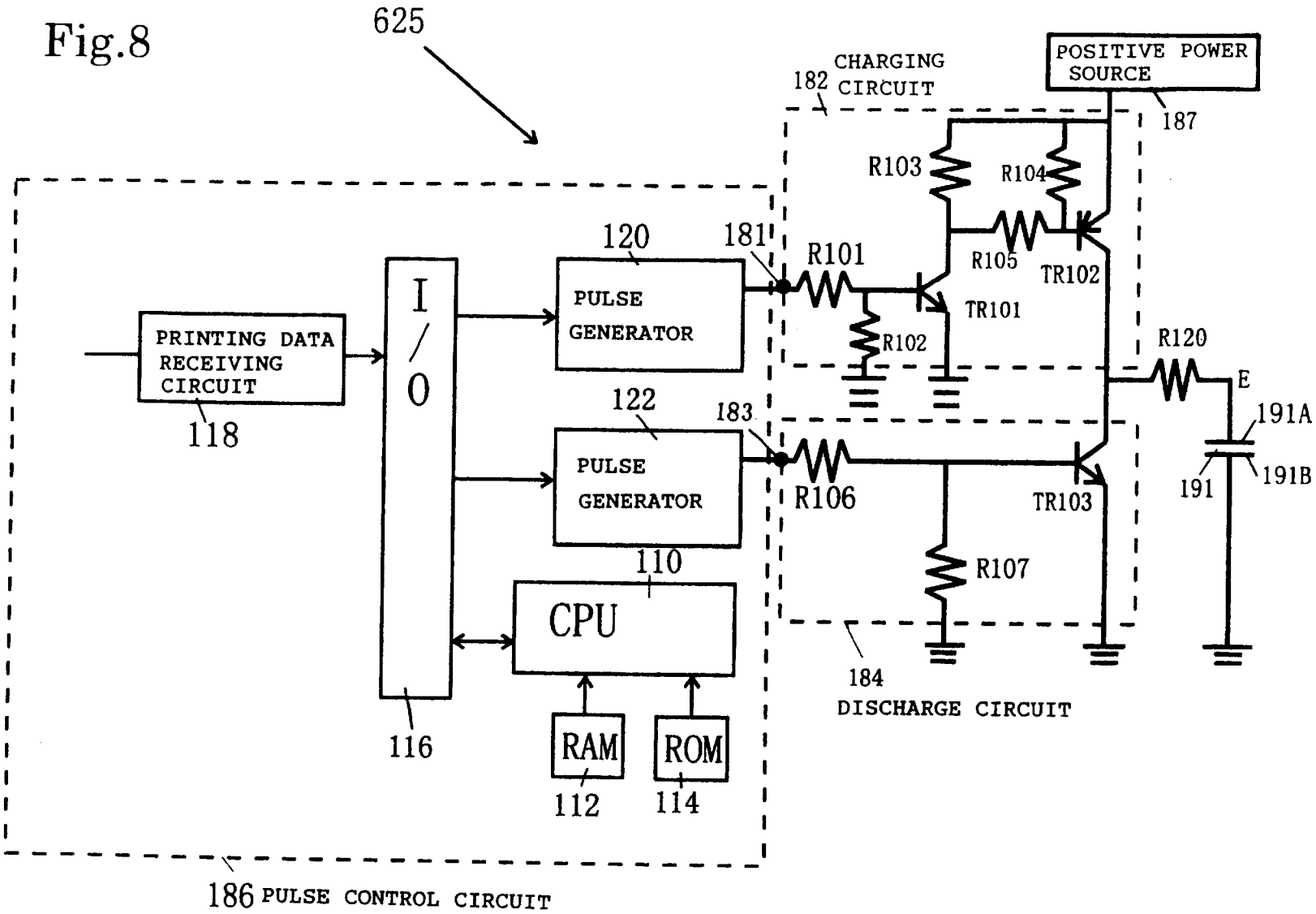
FIG. 8 is a diagram showing a drive circuit in an ink droplet ejecting apparatus embodying the invention.
Figure 9:
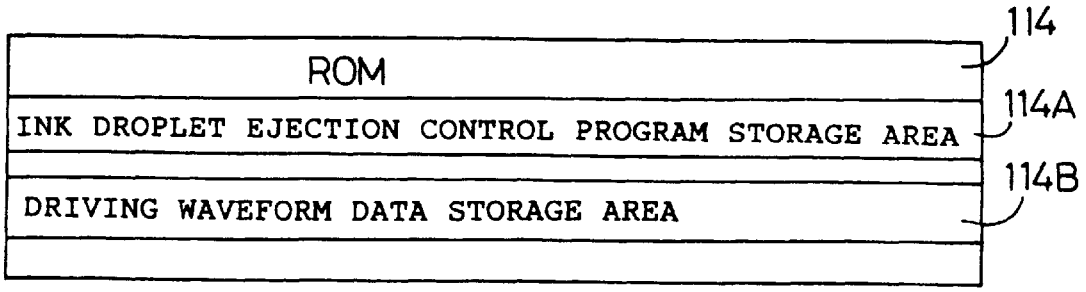
FIG. 9 is a diagram showing storage areas of a ROM in a controller of the ink droplet ejecting apparatus.

Next, an example of a controller for implementing the above driving waveforms will be described with reference to FIGS. 8 and 9. A controller 625 shown in FIG. 8 includes a charging circuit 182, a discharge circuit 184 and a pulse control circuit 186. A piezoelectric material of an actuator wall 603 and electrodes 619, 621 are represented equivalently by a capacitor 191. Numerals 191A and 191B denote terminals thereof.

Input terminals 181 and 183 are for inputting pulse signals to adjust the voltage to be applied to the electrode 619 in each ink chamber 613, to E(V) or O(V). The charging circuit 182 includes resistors R101, R102, R103, R104, R105 and transistors TR101, TR102.

When an ON signal (+5V) is applied to the input terminal 181, the transistor TR101 conducts via resistor 101, so that an electric current flows from a positive power source 187, passes through resistor R103, and flows from the collector to the emitter of transistor TR101. Consequently, a divided voltage of the voltage applied to the resistors R104 and R105, which are connected to the positive power source 187, increases and so does the electric current flowing in the base of the transistor TR102, providing conduction between the emitter and the collector of the transistor TR102. A voltage of 20(V) from the positive power source 187 is applied to the terminal 191A of the capacitor 191 via the collector and emitter of the transistor TR102 and resistor R120.

The following description is now provided regarding the discharge circuit 184. The discharge circuit 184 includes resistors R106, R107 and a transistor TR103. When an ON signal (+5V) is applied to the input terminal 183, the transistor TR103 turns conductive via resistor R106 and the terminal 191 on the resistor R120 side of the capacitor 191A is grounded via resistor R120, so that the electric charge imposed on the actuator wall 603 of the ink chamber 613 shown in FIGS. 12(*a*), 12(*b*) and 13 is discharged.

Reference will now be made to the pulse control circuit 186 which generates pulse signals to be received by the input terminal 181 of the charging circuit 182 and the input terminal 183 of the discharge circuit 184. A CPU 110 is provided in the pulse control circuit 186 which performs various arithmetic operations. To the CPU 110 are connected, a RAM 112 for the storage of printing data and various other data, and a ROM 114 which stores sequence data for generating ON-OFF signals in accordance with control program and timing in the pulse control circuit 186. In the ROM 114, as shown in FIG. 9, an area 114A for the storage of an ink droplet ejection control program, and an area 114B for the storage of driving waveform data, are provided. Sequence data of the driving waveform 10 is stored in the driving waveform data storage area 114B.

The CPU 110 is further connected to an I/O bus 116 for transmission and reception of various data. A printing data receiving circuit 118 and pulse generators 120 and 122 are also connected to the I/O bus 116. The output of the pulse generator 120 is connected to the input terminal 181 of the charging circuit 182, while the output of the pulse generator 122 is connected to the input terminal 183 of the discharge circuit 184.

The CPU 110 controls the pulse generators 120 and 122 in accordance with the sequence data stored in the driving waveform data storage area 114B. Therefore, by having various patterns of the foregoing timing stored beforehand in the driving waveform data storage area 114B of the ROM 114, it is possible to apply a driving pulse of the driving waveform 10 as mentioned above to the actuator wall 603.

The same number of pulse generators 120, 122, charging circuit 182, and discharge circuit 184 are provided as the number of nozzles used. Although the above description is directed to controlling one nozzle, the same control can also be applied to the other nozzles.

Figure 10:
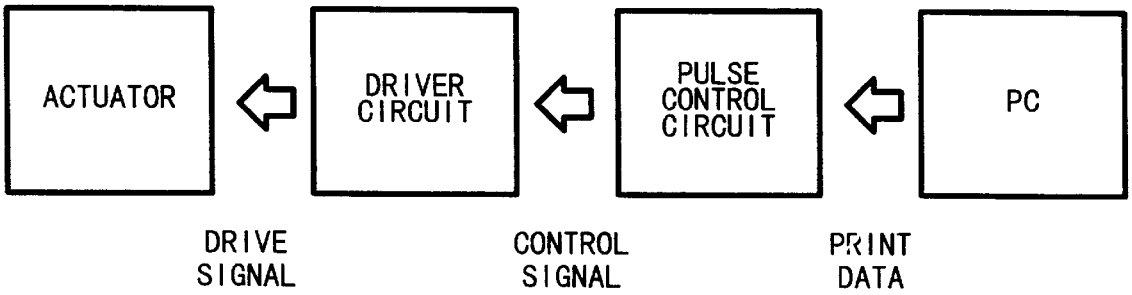
FIG. 10 is a functional block diagram of the controller.

FIG. 10 is a functional block diagram of the controller 625 that shows the flow of a printing instruction signal. In FIG. 10, a printing instruction is supplied from a computer, such as a personal computer (PC), or a word processor, to the pulse control circuit 186 (FIG. 8) where it is applied as a control signal to a driver circuit (the charging circuit 182 and the discharge circuit 184). That is, the printing instruction passes through the printing data receiving circuit 118 and is stored in RAM 112. The CPU 110 using control routines and data stored in ROM 114 outputs signals to the pulse generators 120,122 on the basis of the processed printing instruction. The output of the pulse generators 120, 122 controls to drive an actuator which is an ink channel 613 and represented by capacitor 191.

Figure 11A:
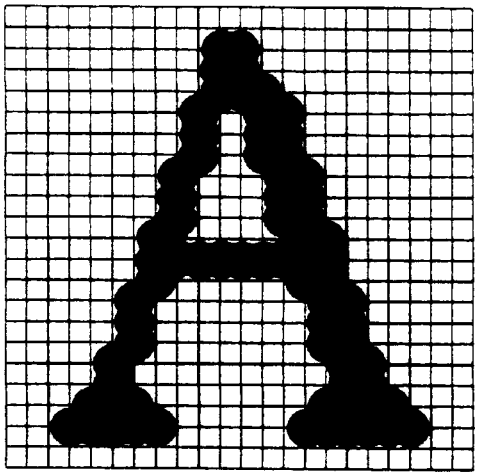
FIG. 11(*a*)–11(*c*) are diagrams showing the results of printing operations respectively performed by conventional methods and the method embodying the invention.
Figure 11B:
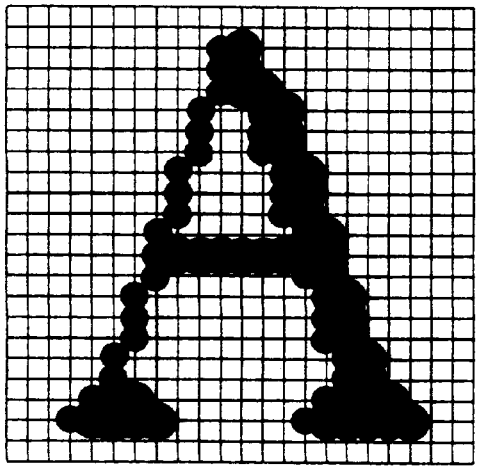
Figure 11C:
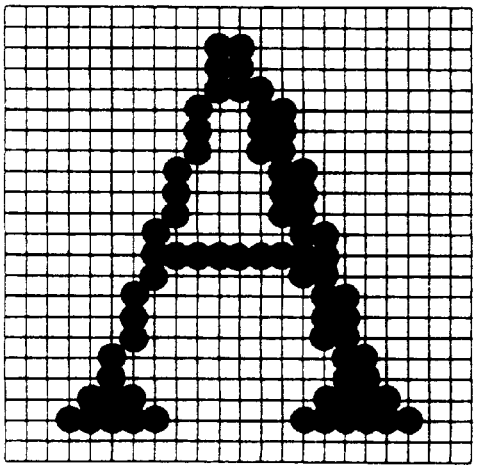

FIGS. 11(*a*)–11(*c*) are diagrams showing the results of printings performed according to conventional methods and the method of this embodiment of the invention. In FIG. 11(*a*), printing was performed using only large dots. The left-hand line, which should be thin, was printed thick. In FIG. 11(*b*), only the first one dot was printed with a small ink droplet according to this embodiment. An attractive print was obtained. In FIG. 11(*c*), printing was performed using only small dots. Gaps are conspicuous between adjacent dots. Thus, according to this embodiment, a satisfactory print can be obtained that has an enhanced resolution at a minute portion, and that is free of a drop-out in white at a continuous dot portion. Also, in halftone dot printing, and recording of such images as photographs, satisfactory results are obtained.

Although an embodiment of the invention has been described above, the invention is not limited thereto. For example, the ink droplet ejecting apparatus 600 is not limited to the structure described in the above embodiment. A similar apparatus may be used that is opposite in polarizing direction of the piezoelectric material. Although in the above embodiment, air chambers 615 are formed on both sides of each ink chamber 613, the ink chambers may also be formed in a directly adjacent manner without forming such air chambers. Further, although the actuator used in the above embodiment is a shear mode type, a structure may also be adopted wherein layers of a piezoelectric material are laminated together, and a pressure wave is generated by a deformation in the laminated direction. No limitation is placed on the piezoelectric material, and any other material can be used insofar as a pressure wave is generated in each ink chamber.

What is claimed is:

1. An ink droplet ejecting method, wherein a jet pulse signal is applied to an actuator, for changing volume of an ink chamber filled with ink, to generate a pressure wave within the ink chamber, thereby applying pressure to the ink and allowing an ink droplet to be ejected from a nozzle, comprising the steps of:

applying, in accordance with a single dot or multiple continuous dots printing instruction, one or multiple jet pulse signals to said actuator at a predetermined cyclic timing to eject the ink droplet; and shaping the one or multiple jet pulse signals so that, in a continuous ejection of ink, a small ink droplet is only ejected at a first ink ejection and larger ink droplets are ejected at second and subsequent ink ejections.

2. The ink droplet ejecting method according to claim 1, further including the step of shaping the one or multiple jet pulse signals so that, when ejecting ink at intervals of at least one dot, only small ink droplets are ejected.

3. The ink droplet ejecting method according to claim 1, wherein the step of shaping includes shaping the one or multiple pulse signals to eject a small ink droplet including at least one of the steps of:

reducing a size of a peak value of a pulse signal;

reducing a size of a width of a pulse signal;

adding a control pulse to a pulse signal;

changing a rise timing or fall timing of a pulse signal; and changing a printing frequency of a pulse signal.

4. The ink droplet ejecting method according to claim 3, wherein the step of changing a printing frequency of a pulse signal includes setting a printing frequency of a predetermined timing period to be a reciprocal of an even-numbered multiple of a time T in which a pressure wave propagates within the ink chamber one-way when larger ink droplets are ejected at second and subsequent ink ejections.

5. The ink droplet ejecting method according to claim 3, wherein the step of changing a printing frequency of a pulse signal includes setting a printing frequency of a predetermined timing period to be a range centered around a reciprocal of an even-numbered multiple of a time T in which a pressure wave propagates within the ink chamber one-way when larger ink droplets are ejected at second and subsequent ink ejections, wherein the range is defined as $(2N-0.4)\times T$ to $(2N+0.4)\times T$, wherein N is an integer.

6. The ink droplet ejecting method according to claim 2, wherein the step of shaping in a continuous ejection of ink, and the step of shaping when ejecting ink at intervals of only one dot, each include shaping the one or multiple pulse signals to eject a small ink droplet including at least one of the steps of:

reducing a size of a peak value of a pulse signal;

reducing a size of a width of a pulse signal;

adding a control pulse to a pulse signal;

changing a rise timing or fall timing of a pulse signal; and changing a printing frequency of a pulse signal.

7. The ink droplet ejecting method according to claim 1, wherein the step of shaping one or multiple jet pulse signals includes shaping the one or multiple jet pulse signals with a controller that has a charging circuit, a discharge circuit, and a pulse control circuit.

8. The ink droplet ejecting method according to claim 7, wherein the step of shaping one or multiple jet pulse signals with a controller includes shaping one or multiple jet pulse signals with a pulse control circuit that has a CPU, a RAM, a ROM, an I/O Bus, a printing data receiving circuit, and pulse generators.

9. The ink droplet ejecting method according to claim 8, wherein the step of shaping one or multiple jet pulse signals with a pulse control circuit includes shaping one or multiple jet pulse signals with a ROM that has an ink droplet ejection control program storage area and a driving waveform data storage area.

10. An ink droplet ejecting apparatus for use with ink, comprising:

an ink chamber fillable with ink;

an actuator for changing volume of said ink chamber;

a driving power source for applying an electric signal to said actuator; and a controller which provides control so that, in accordance with a one-dot printing instruction, a jet pulse signal is applied to said actuator from said driving power source to eject ink present in said ink chamber, the controller providing control so that, in accordance with a single dot or multiple continuous dots printing instruction, one or multiple jet pulse signals are applied to said actuator at a predetermined cyclic timing to eject an ink droplet, and the one or multiple jet pulse signals are shaped so that, in a continuous ejection of ink, a small ink droplet is only ejected at a first ink ejection and larger ink droplets are ejected at second and subsequent ink ejections.

11. The ink droplet ejecting apparatus according to claim 10, wherein said controller provides control so that the one or multiple jet pulse signals are shaped so that, when ejecting ink at intervals of at least one dot, only small ink droplets are ejected.

12. The ink droplet ejecting apparatus according to claim 10, wherein the controller provides control so that the one or multiple pulse signals are shaped in a continuous ejection of ink to eject a small ink droplet by at least one of:

reducing a size of a peak value of a pulse signal;

reducing a size of a width of a pulse signal;

adding a control pulse to a pulse signal;

changing a rise timing or fall timing of a pulse signal; and changing a printing frequency of a pulse signal.

13. The ink droplet ejecting apparatus according to claim 12, wherein the changing of a printing frequency of a pulse signal includes setting a printing frequency of a predetermined timing period to be a reciprocal of an even-numbered multiple of a time T in which a pressure wave propagates within the ink chamber one-way when larger ink droplets are ejected at second and subsequent ink ejections.

14. The ink droplet ejecting apparatus according to claim 12, wherein the changing of a printing frequency of a pulse signal includes setting a printing frequency of a predetermined timing period to be a range centered around a reciprocal of an even-numbered multiple of a time T in which a pressure wave propagates within the ink chamber one-way when larger ink droplets are ejected at second and subsequent ink ejections, wherein the range is defined as $(2N-0.4)\times T$ to $(2N+0.4)\times T$, wherein N is an integer.

15. The ink droplet ejecting apparatus according to claim 11, wherein the controller provides control so that the one or multiple pulse signals are shaped in a continuous ejection of ink, and when ejecting ink at intervals of only one dot, to eject a small ink droplet by at least one of:

reducing a size of a peak value of a pulse signal;

reducing a size of a width of a pulse signal;

adding a control pulse to a pulse signal;

changing a rise timing or fall timing of a pulse signal; and changing a printing frequency of a pulse signal.

16. The ink droplet ejecting apparatus according to claim 10, wherein the controller includes a charging circuit, a discharge circuit, and a pulse control circuit.

17. The ink droplet ejecting apparatus according to claim 16, wherein the pulse control circuit includes a CPU, a RAM, a ROM, an I/O Bus, a printing data receiving circuit, and pulse generators.

18. The ink droplet ejecting apparatus according to claim 17, wherein the ROM includes an ink droplet ejection control program storage area, and a driving waveform data storage area.

19. A storage medium, comprising:

a program for applying, in accordance with a single dot or multiple continuous dots printing instruction, one or multiple jet pulse signals to an actuator at a predetermined cyclic timing to eject an ink droplet; and a program for shaping the one or multiple jet pulse signals so that, in a continuous ejection of ink, a small ink droplet is only ejected at a first ink ejection and larger ink droplets are ejected at second and subsequent ink ejections.

20. The storage medium according to claim 19, further including a program for shaping the one or multiple jet pulse signals so that, when ejecting ink at intervals of at least one dot, only small ink droplets are ejected.

21. The storage medium according to claim 19, wherein the program for shaping includes a program for shaping the one or multiple pulse signals to eject a small ink droplet by at least one of:

reducing a size of a peak value of a pulse signal;

reducing a size of a width of a pulse signal;

adding a control pulse to a pulse signal;

changing a rise timing or fall timing of a pulse signal; and changing a printing frequency of a pulse signal.

22. The storage medium according to claim 20, wherein the program for shaping in a continuous ejection of ink, and the program for shaping when ejecting ink at intervals of only one dot includes a program for shaping the one or multiple pulse signals to eject a small ink droplet by at least one of:

reducing a size of a peak value of a pulse signal;

reducing a size of a width of a pulse signal;

adding a control pulse to a pulse signal;

changing a rise timing or fall timing of a pulse signal; and changing a printing frequency of a pulse signal.

* * * * *